United States Patent [19]

Goralnik

[11] Patent Number: 4,477,866

[45] Date of Patent: Oct. 16, 1984

[54] CHANDELIERS

[75] Inventor: Charles D. Goralnik, St. Louis County, Mo.

[73] Assignee: Vogue Lighting, Inc., St. Louis, Mo.

[21] Appl. No.: 545,685

[22] Filed: Oct. 26, 1983

[51] Int. Cl.[3] ..... F21M 3/18

[52] U.S. Cl. ..... 362/427; 362/250; 362/252; 362/285; 362/405; 362/431; 362/450

[58] Field of Search ..... D26/72; 362/405, 406, 362/427, 250, 252, 285, 431, 450

[56] References Cited

U.S. PATENT DOCUMENTS 3,979,584 9/1976 Fossati ..... 362/405

*Primary Examiner*—Stephen J. Lechert, Jr.

*Attorney, Agent, or Firm*—Senniger, Powers, Leavitt and Roedel

[57] ABSTRACT

Chandeliers having a center column, a circular arm supporting plate attachable to the center column, and a plurality of arms attachable or attached to the plate, the chandelier being adapted to be compactly packaged with said parts in a knocked-down or knocked-down and folded condition, and to be readily set up with the arms in an operative position extending radially outwardly from the plate.

22 Claims, 17 Drawing Figures

CHANDELIERS

BACKGROUND OF THE INVENTION

This invention relates to chandeliers, and more particularly to collapsible chandelier constructions.

The invention is generally in the same field as the chandeliers disclosed in U.S. PAT. No. 3,831,022.

SUMMARY OF THE INVENTION

Among the several objects of this invention may be noted the provision of improved collapsible chandeliers adapted to be packaged for shipment and warehousing in a compact condition to save packaging, freight and warehousing costs; and the provision of such chandeliers of simplified and more economical construction, adapted readily to be set up from their collapsed condition by the person installing the chandelier, and securely maintained in their set-up condition.

A first embodiment of the chandelier of this invention comprises a circular arm supporting plate and a plurality of arms mounted on the plate in position extending radially outwardly from the plate. The plate has a plurality of radial slots extending to its periphery for mounting the arms. Each slot has generally parallel side edges. Each arm has a slide mount mounting it in a respective slot. Each slide mount comprises a sheet metal slide member adapted to be slid into the respective slot having vertically offset upper and lower tabs formed integrally with the member from the sheet meal of the member defining between said upper and lower tabs quide channels for receiving the boundary edges of a slot. And means is provided at the inner end of each slide mount for securement to the plate.

In other embodiments of this invention, each arm is mounted on the plate for pivotal movement about an axis generally perpendicular to the plate from a collapsed position for shipment and storage to an operative position extending radially outwardly from the plate. Each of said arms is a metal tubular arm accommodating electrical wiring therein and having an end portion rotatable in a hole in the plate for swinging the arm relative to the plate. A detent is secured to said end portion of each arm for rotation therewith at one face of the plate. The plate is formed with a plurality of openings, one for each detent, for receiving a portion of each detent to located the respective arm in its operative position, and each detent is constructed and arranged to spring into position for interengagement of said portion of the detent in the respective detent-receiving opening as the detent is rotated with the respective arm when the arm is swung from its collapsed to its operative position.

In another aspect, each of the embodiments comprises a tubular center column, arm supporting plate attached to the lower end of the column and a plurality of arms mounted on the plate. Each arm is a metal tubular arm having a downwardly extending inner end portion attached at its lower end to the plate, an outwardly extending intermediate portion and an upwardly extending outer end portion carrying a lamp socket. The attachment of each arm to the plate and the attachment of the plate to the column are such as to enable the chandelier to be packaged with the plate detached from the column and with the arms in a nested condition, and to enable the plate to be attached to the column and the arms set in operative position extending radially outwardly from the plate. The arms accommodate wiring with the wiring extending through the column to below the plate and out to and up through the lower ends of the inner end portions of the arms and a housing is attachable to the plate for enclosing wiring below the plate.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
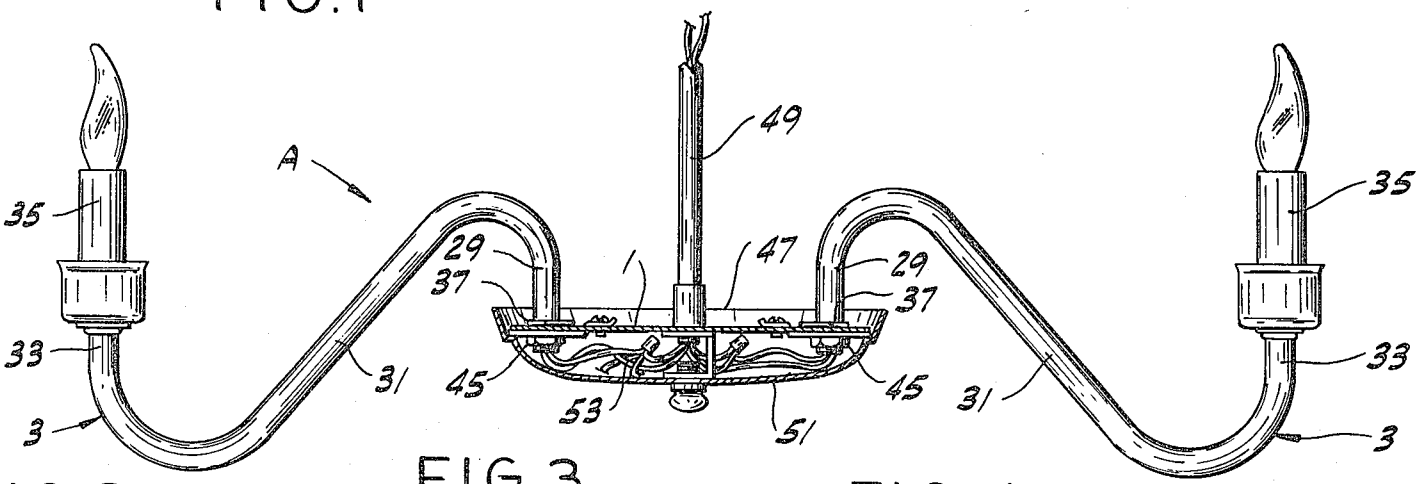
FIG. 1 is a view in side elevation with parts broken away and shown in section of a first embodiment of a chandelier of this invention, showing two of the arms of the chandelier (which typically has five arms) in their set-up condition.
Figure 4:
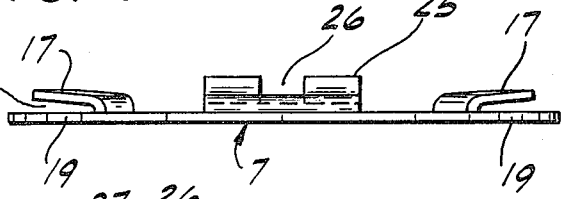
FIG. 4 is an enlarged end elevation of the slide mount, viewed from the left of FIGS. 2 and 3.
Figure 3:
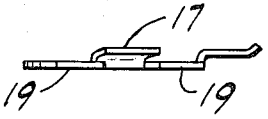
FIG. 3 is a side elevation of the slide mount.
Figure 5:
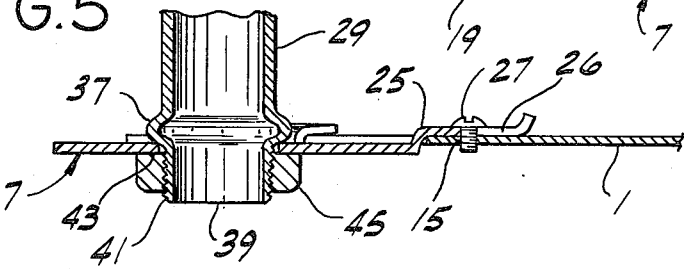
FIG. 5 is a vertical section on line 5—5 of FIG. 6.
Figure 2:
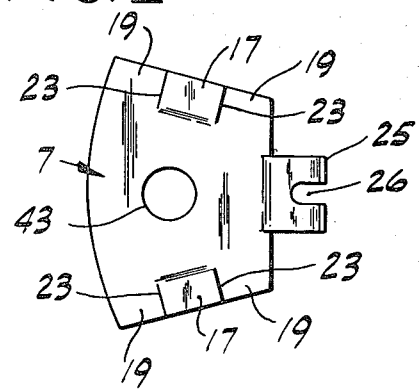
FIG. 2 is a plan of a slide mount per se of the FIG. 1 chandelier.
Figure 6:
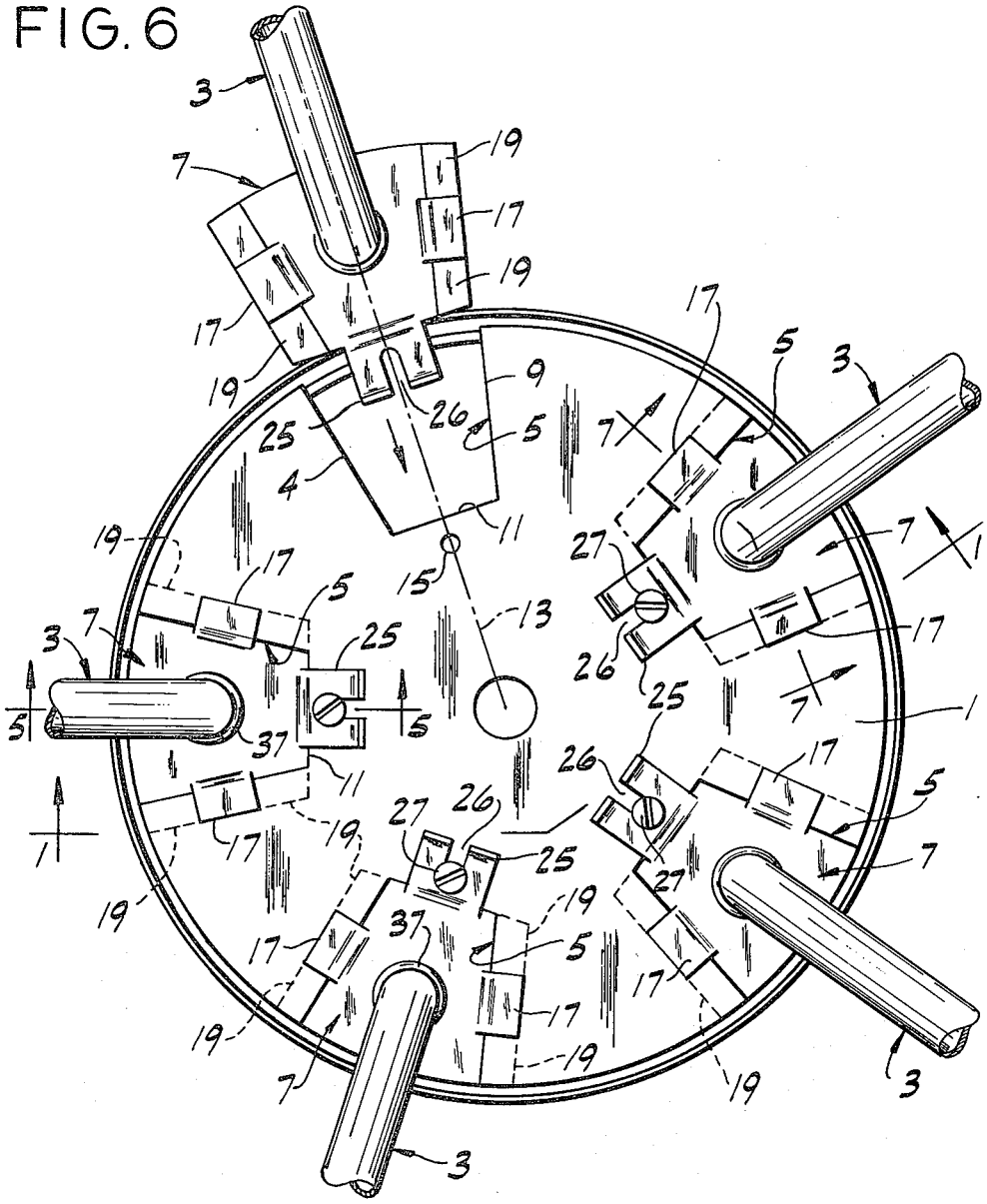
FIG. 6 is a plan of a central arm-supporting plate of the chandelier on a larger scale than that of FIG. 1 showing four of five arms of the chandelier set up, and the fifth in the process of being set up.
Figure 7:
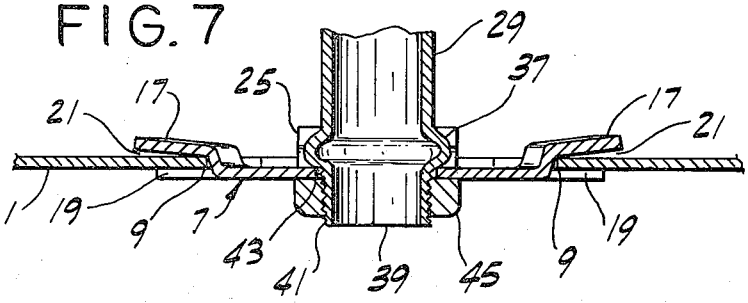
FIG. 7 is an enlarged vertical section on line 7—7 of FIG. 6.

Referring first to FIG. 1 of the drawings, a chandelier A constituting a first embodiment of this invention is shown to comprise a circular arm supporting or mounting plate 1 and a plurality of arms each designated 3 mounted in their set-up or erected position on the plate extending radially outwardly from the plate. The chandelier typically has five such arms which, as set up or erected, extend radially outwardly from the plate 3 at 72° intervals (see FIG. 6). The plate 1 has a plurality of radial slots each designated 5 (five such slots being shown for the five arms) extending to its periphery for mounting the arms. Each arm has a slide mount 7 mounting it in a respective slot 5.

Each slot 5 in the plate 1 is of part-sector shape, having side edges 9 which converge toward one another inward from the periphery of the plate and an inner end edge 11 at right angles to the central radius 13 of the slot. The plate is provided with a screw hole 15 inward of and adjacent the inner end edge 11 of each slot on the central radius of the slot.

Each slide mount 7 comprises a flat sheet metal member generally of part-sector shape corresponding to the shape of slots 5 adapted to be slid into a respective slot. This sheet metal slide mount member has vertically offset upper and lower tabs 17 and 19 formed integrally with the member from the sheet metal of the member at each side of said member defining between these tabs guide channels indicated at 21 for receiving the boundary side edges 9 of a slot. These tabs are very simply and expeditiously formed by cutting slits at 23 in a flat piece from which member 7 is formed, these slits extending inward from opposite sides of the piece and dividing each side margin of the piece into the three tabs, and then striking up the resultant center tabs to offset them upwardly from the plane of the piece to form the upper tabs 17. The lower tabs 19, which are at the ends of the sides of the piece, are left as is in the plane of the piece. Each slide mount is also formed with a tab 25 at its inner end which is struck up to be offset upwardly from the plane of the piece, this end tab having a slot 26 for receiving a screw 27 which threads into the hole 15 at the inner end of the slot 7 for securement of the slide mount 7 to the plate 1.

Each chandelier arm 3 is formed of a length of metal tubing bent into the shape of an S, having a downwardly extending inner end portion 29, an outwardly and downwardly extending intermediate inclined portion 31 and an upwardly extending outer end portion 33 carrying a lamp socket 35. Each arm has an integrally formed outwardly extending annular flange formation 37 adjacent the lower end of the downwardly extending inner end portion 29, the lower end portion of the arm below this flange, designated 39, being exteriorly threaded as indicated at 41. This lower end portion of the arm is inserted in a hole 43 in a respective slide mount 7 with the flange formation 37 engaging the upper face of the slide mount, and secured in place by means of a nut 45 threaded up on portion 39 into engagement with the bottom of the slide mount.

The circular mounting plate 1 is secured as indicated at 47 to the lower end of a central tubular support member of column 49 by means of which the chandelier is hung from the ceiling. A generally saucer-shaped housing or canopy 51 is suitably mounted on the bottom of the plate 1 (as indicated at 53, for example) to enclose electrical conductors such as indicated at 53 which extend down through the tubular central support member of column to below the bottom of plate 1 and then extend out to and through the tubular arms 3.

It will be observed that the chandelier A comprises five arm and slide mount assemblies (each comprising an arm 3 and the slide mount 7 to which it is secured at the lower end of arm portion 29), the center mounting plate 1, the center support member or column 49 and the housing 51. The chandelier may be packaged in disassembled or knocked-down condition, i.e., the five arm and slide mount assemblies, the plate 1, the center support member 49, and the housing 51 are packaged as separate entities in compact fashion in an appropriate carton (for example). Generally, the arms are pre-wired but the column 49 is not, the wiring therefor being supplied separately in the package, and strung by the end user. The parts are adapted readily to be assembled or set up to form the chandelier by sliding the slide mount 7 of each arm 3 into a respective slot 5, the tabs 17 and 19 at the sides of the slide mount straddling the boundary side edges 9 of the slot, to the point where the inner end of the slide mount is at the inner end 11 of the slot. As the slide mount is so slid inward, the tab 25 at the inner end of the slide mount comes into position over the plate 1 adjacent the inner end 11 of the slot 9, with slot 26 in the tab aligned with the screw hole 15 adjacent the inner end of the slot 9. Then, screw 27 (supplied in the package) may be threaded into the hole 15 and tightened to secure the slide mount and hence the arm 3 in place with respect to the plate 1. The center support member or column 49 may then be secured to the plate, the wiring completed, and housing 51 applied.

Figures 8, 9, 10:
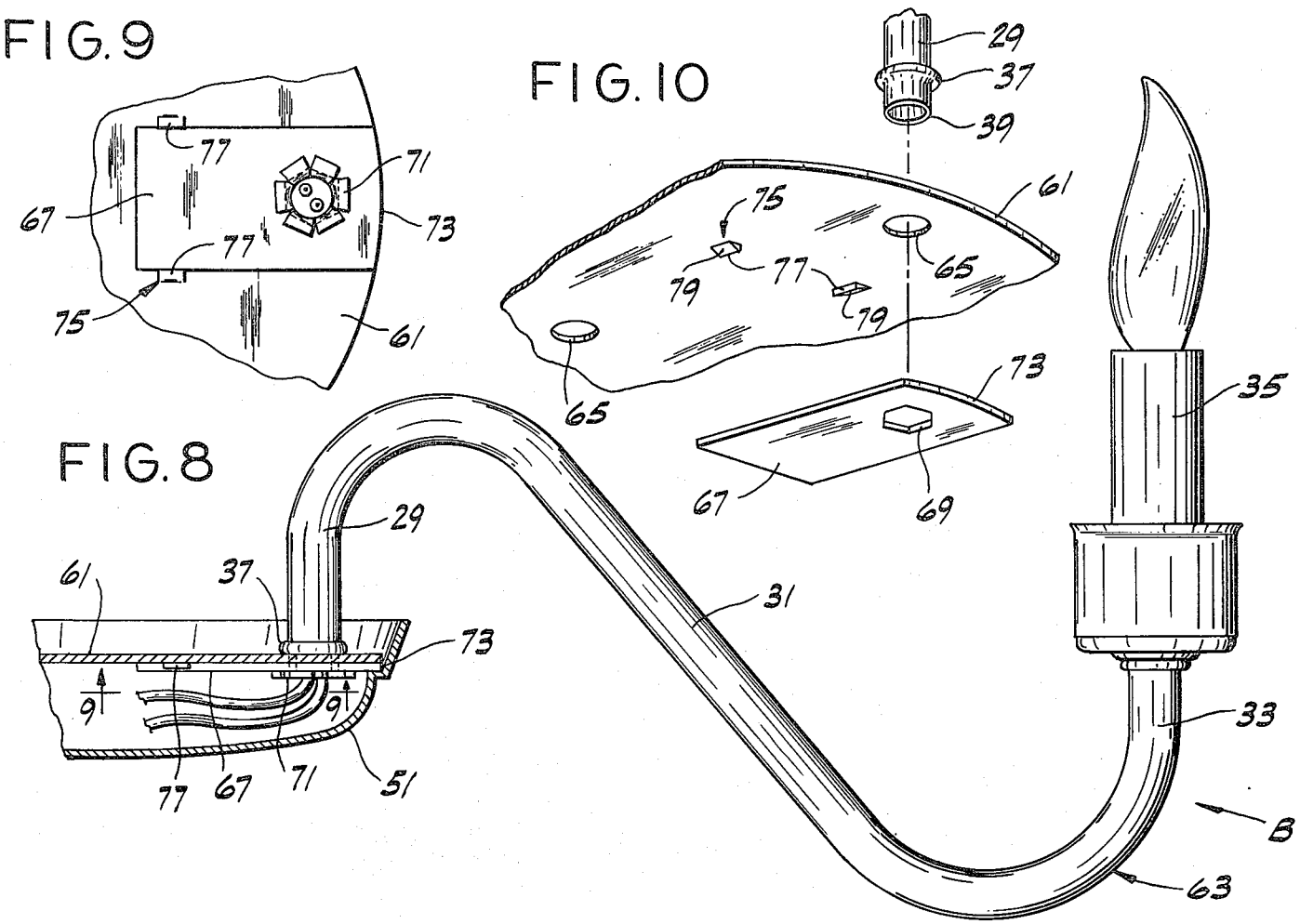
FIG. 8 is a view in side elevation with parts broken away and shown in section of part of a second embodiment of the chandelier of this invention, showing an arm in its set-up condition.
FIG. 9 is a view on line 9—9 of FIG. 8.
FIG. 10 is an exploded perspective of part of FIG. 8.
Figure 11:
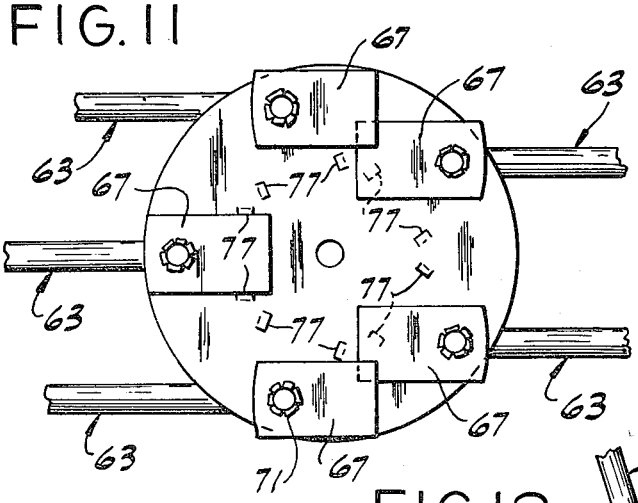
FIG. 11 is a partial bottom plan illustrating the FIG. 8 fixture with the arms in folded condition.
Figure 12:
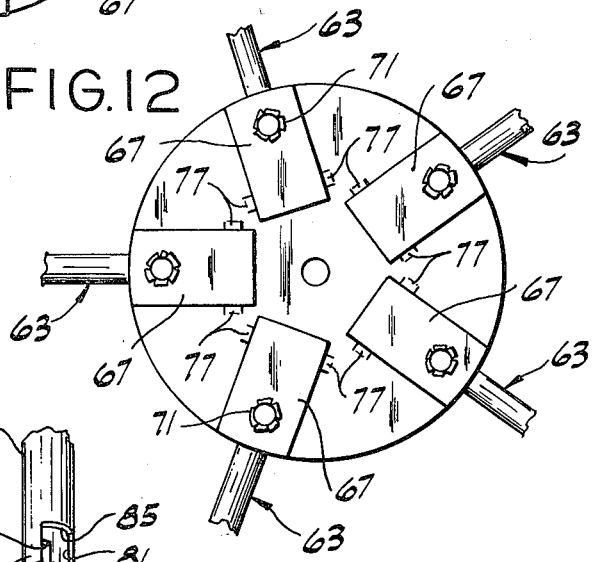
FIG. 12 is a view similar to FIG. 11 showing the arms unfolded to their set-up position.

Now referring to FIG. 8–12, a chandelier B constituting a second embodiment of the invention is shown to comprise a circular arm supporting or mounting plate 61 and a plurality of arms each designated 63, and each of which is mounted on the plate 61 for pivotal movement about an axis generally perpendicular to the plate from a folded or collapsed position such as illustrated in FIG. 11 for packaging, shipment and storage to an operative position such as illustrated in FIG. 12 extending radially outwardly from the plate. Each of the arms is similar to the arms 3 of the first embodiment, being a tubular metal arm having the downwardly extending inner end portion 29, the intermediate inclined portion 31 and the upwardly extending outer end portion 33 carrying lamp socket 35. Each arm has the integrally formed outwardly extending annular flange 37 adjacent the lower end of the downwardly extending inner end portion 29, the lower end of the arm below this flange again being designated 39. This portion 39, which is not threaded, extends down through a circular hole 65 in plate with the flange 37 engaging the upper face of the plate and is keyed to a flat, springy sheet metal detent member or latch 67 which is generally in flatwise engagement with the bottom of plate 61 in such manner that the detent member is rotatable with the arm about the vertical axis of the downwardly extending inner end portion 29 of the arm. As illustrated in FIGS. 9 and 10, this keying is effected by forming the detent 67 with a non-circular hole 69 (e.g., a hexagonal hole) adjacent one of its ends which is its outer end relative to the center of plate 61, and flaring or swaging the lower end portion 39 of portion 27 of the arm outwardly as indicated at 71 in FIG. 9 into engagement with the non-circular boundary edge of the non-circular opening, thereby not only securing the detent to the arm for rotation therewith about the vertical axis of the downwardly extending inner end portion 29 of the arm, but also forcing the detent upwardly tight against the bottom of plate 1. The detent, as illustrated, is generally a rectangular sheet metal part; its outer end edge 73 may be slightly convexly curved as appears in FIGS. 9 and 10 is desired.

The plate 1 is formed with a plurality of pairs of retainer or latching tabs, one pair for each detent, each such pair being generally indicated at 75 and each tab of the pair being designated 77, for automatically latching each of the arms in its operative position extending radially outwardly from the plate 61 when the arm is swung to said operative position. These latching tabs 77 are formed by striking out portions of the plate 61, the two tabs of each pair being located inwardly from the vertical axis of the downwardly extending inner end portion 29 of the respective arm and latch member on opposite sides of the radius of the plate which extends through said vertical axis. The tabs extend toward one another below the bottom face of the plate, with their free ends spaced apart a distance very slightly greater than the width of the latch member 67 thereby providing a space or opening between the free ends of the tabs for receiving the detent, and with the bottom faces 79 of the tabs forming inclined ramps or cam surfaces for a purpose that will appear.

The chandelier B has its arms 63 pre-assembled with the center mounting plate 61 with four of its five arms in the folded or collapsed position illustrated in FIG. 11 wherein the detents 67 for these four arms are angularly offset from the respective pairs of tabs, and with one arm (the central arm at the left) extending radially outwardly from the plate with its detend latched in position between the respective pair of tabs. With the arms in this position, the plate/arm assembly may be packaged in compact fashion in an appropriate carton (for example) along with the tubular center support or column 49 (disassembled from the plate 61) and the housing or canopy 51. The arms may be pre-wired. The chandelier is then readily set up by the end user simply by pivoting the four arms 63 which were in the collapsed or folded position to their operative positions as shown in FIG. 12 extending radially outwardly from the plate, these arms automatically becoming latched in their said operative position by the swinging of the detents 67 with the arms to the radial position in centered relation to the respective pair 75 of latching tabs 77 and lodged in the openings between the inner ends of the tabs. In this regard, it will be observed that as a detent swings around, it rides over the inclined bottom face of one or the other tabs 77 of the respective pair of tabs, being flexed downwardly thereby and, on clearing that tab, springs back up into the space or opening between the two tabs to become lodged between them and thereby latched in place, thereby latching the arm in its operative position.

Figure 13:
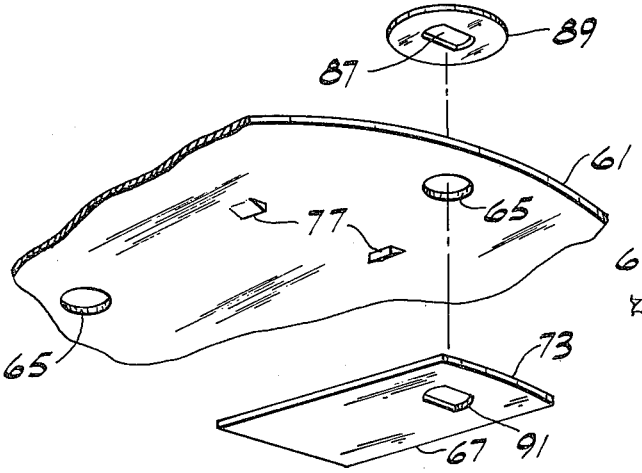
FIG. 13 is an exploded perspective illustrating a third embodiment involving a variation of the second.
Figure 14:
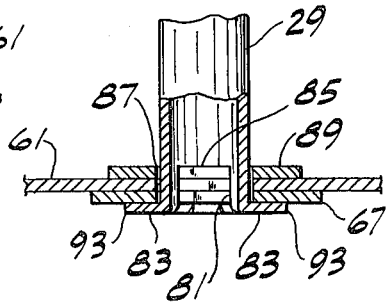
FIG. 14 is an enlarged section of the final assembly of parts shown in FIG. 13.

FIGS. 13 and 14 illustrate a third embodiment of the chandelier similar to chandelier B with a modification in the lower end of each arm. What this involves is that, instead of forming the arm with the integral flange formation 37 for engagement with the top of the center plate 61, the downwardly extending inner end portion 29 of the arm is formed with a pair of slots each designated 81 extending up from its lower end. These slots are diametrically opposite one another centered in an axial central plane of the lower end portion of the arm. Portions of the arm remaining after these slots have been formed, constituting tongues at the lower end of the inner portion 29 of the arm, are designated 83. This formation presents a shoulder 85 at the inner end of each slot. The tongues 83 extend through a hole 87 in a flat metal washer 89 which bears on the plate 61. This hole 87 is shaped for engagement of the washer with the shoulders 85 to keep the washer from sliding axially on the inner end portion 29 of the arm 63 away from the plate 61. Thus, as illustrated, the hole 87 is generally of rectangular shape with curved ends conforming to the curvature of the outer faces of the tongues 83. The washer engages the shoulders at the sides of the hole. The tongues extend through the non-circular hole 91 in the detent 67, this hole being shaped the same as the hole 87 in the washer, and the lower ends of the tongues are swaged outwardly into engagement with the lower face of member 67 as indicated at 93 in FIG. 14.

Figure 15:
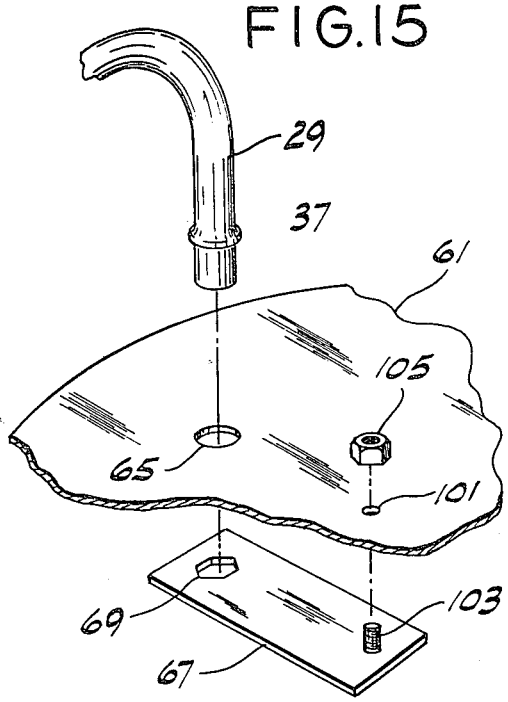
FIGS. 15–17 are exploded views illustrating additional embodiments.

FIG. 15 illustrates a modification of the embodiment of FIGS. 8–12 wherein the plate 61, instead of being formed with the tabs 77, is formed with an opening or hole 101 therein for each detent 67 for receiving a threaded stud 103 on the detent, this stud extending from the detent up toward the plate 61. The arrangement is such that as the detent rotates with the arm when is swung from the collapsed to the operative position, the stud springs up into the hole 101. It then projects above plate 61, and a nut 105 may be threaded thereon tightly to secure it in the hole. This enables manufacture with greater tolerance which might otherwise result in the studs 103 being somewhat loose in the holes 101.

Figure 16:
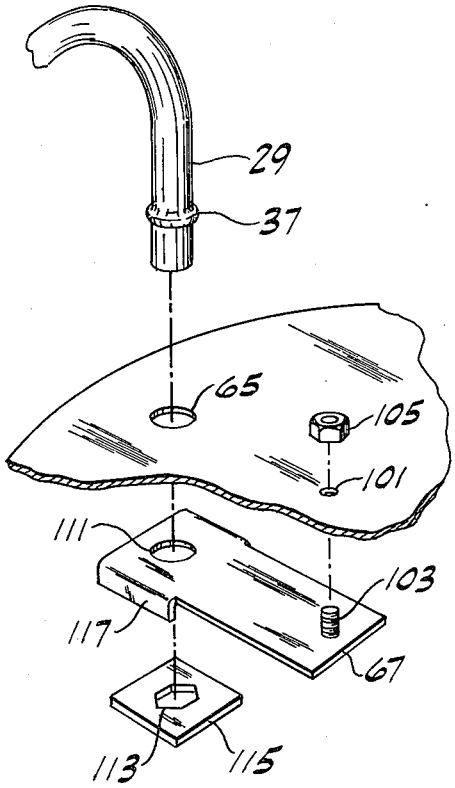

FIG. 16 illustrates another embodiment similar to FIG. 15 wherein the lower end of portion 29 of the arm extends through a circular hole 111 in the detent and a non-circular hole 113 in a square retainer 115 and is swaged outwardly as at 39 into engagement with the non-circular boundary edge of the non-circular hole 113. The retainer engages a flange 117 on the detent 67 for rotation of the detent with the retainer.

Figure 17:
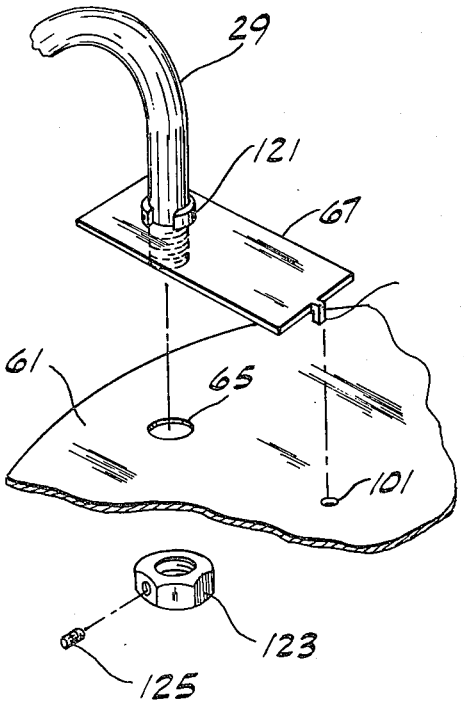

FIG. 17 illustrates another embodiment in which the detent, again designated 67, is spot welded at 121 to the arm above the lower end of the arm, and is disposed on top of the plate 61. The lower end portion of the arm, which is threaded, extends down through hole 65 on the plate and has a nut 123 threaded thereon to hold it in place. A set screw 125 locks the nut 123 on the lower end portion of the arm. Other suitable locking means may be used. The stud in this instance is constituted by a tab 127 bent down from the detent at its free end, the tab being engageable in hole 101 in plate 61.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A chandelier comprising a tubular center column, a circular arm supporting plate attached to the lower end of the column, a plurality of arms mounted on the plate, each arm being a metal tubular arm having a downwardly extending inner end portion attached at its lower end to the plate, an outwardly extending intermediate portion and an upwardly extending outer end portion carrying a lamp socket, the attachment of each arm to the plate and the attachment of the plate to the column being such as to enable the chandelier to be packaged with the plate detached from the column and with the arms in a nested condition, and to enable the plate to be attached to the column and the arms set in operative position extending radially outwardly from the plate, the arms accommodating wiring with the wiring extending through the column to below the plate and out to and up through the lower ends of the inner end portions of the arms, and a housing attachable to the plate for enclosing wiring below the plate.

2. A chandelier comprising a circular arm supporting plate and a plurality of arms mounted on the plate in position extending radially outwardly from the plate, the plate having a plurality of radial slots extending to its periphery for mounting the arms, each slot having generally parallel side edges, each arm having a slide mount mounting it in a respective slot, each slide mount comprising a sheet metal slide member adapted to be slid into the respective slot having vertically offset upper and lower tabs formed integrally with the member from the sheet metal of the member defining between said upper and lower tabs guide channels for receiving the boundary edges of a slot, and means at the inner end of each slide mount for securement to the plate.

3. A chandelier as set forth in claim 2 wherein each arm is secured in a hole in the respective slide mount.

4. A chandelier as set fourth in claim 3 wherein each arm is tubular for passage of wiring with the wiring extending out of the arm at the slide mount.

5. A chandelier as set forth in claim 2 wherein the securement means at the inner end of each slide mount comprises a tab extending from the inner end of the slide mount over a face of the place and a fastener for securing said last-named tab to the plate.

6. A chandelier as set forth in claim 5 wherein said tab at the inner end of the slide mount has a slot extending lengthwise thereof and said fastener comprises a screw extending through the slot threaded in a hole in the plate.

7. A chandelier as set forth in claim 6 wherein each slot has sides which converge toward one another in inward direction and each slide mount is of a shape corresponding to that of the slots.

8. A chandelier as set forth in claim 7 wherein each arm is tubular for passage of wiring and is secured in a hole in a respective slide mount, the wiring extending out of the arm at the slide mount.

9. A chandelier as set forth in claim 4 having a tubular center column, the plate being attached to the lower end of the column, each arm having a downwardly extending inner end portion secured in the hole in the respective slide mount, and outwardly extending intermediate portion and an upwardly extending outer end portion carrying a lamp socket, the wiring extending through the column to below the plate and out to and up through the lower ends of the inner end portions of the arms, and a housing attachable to the plate for enclosing wiring below the plate.

10. A chandelier comprising an arm supporting plate, a plurality of arms mounted on the plate for pivotal movement about axes generally perpendicular to the plate from a collapsed position for shipment and storage to an operative position extending outwardly from the plate, each of said arms being a metal tubular arm accommodating electrical wiring therein and having an end portion rotatable in a hole in the plate for swinging the arm relative to the plate from a collapsed position of the arm to the operative position, a plurality of detents, one for each arm, each secured to the said end portion of the respective arm for rotation therewith at one face of the plate, the plate being formed with a plurality of openings, one for each detent, for receiving a portion of each detent to locate the respective arm in its said operative position, each detent being constructed and arranged to spring into position for the interengagement of said portion of the detent in the respective detent-receiving opening as the detent is rotated with the respective arm when the arm is swung from its collapsed to its operative position.

11. A chandelier as set forth in claim 10 wherein each detent comprises a flat sheet metal member secured to the respective arm on one face of the plate, said end portion of each arm extending through the respective hole in the plate and having means thereon at the other face of the plate retaining said end portion in place.

12. A chandelier as set forth in claim 10 wherein each arm has means associated therewith engageable with one face of the plate, and the detent comprises a flat sheet metal member on the other face of the plate.

13. A chandelier as set forth in claim 12 wherein the detent has a non-circular hole therein receiving the said end portion of the arm, and the latter is deformed outwardly into engagement with the boundary of the non-circular opening for securing the detent to the arm for rotation therewith.

14. A chandelier as set forth in claim 12 wherein the means associated with the arm engageable with said one face of the plate comprises an annular outwardly extending integral head formation of the arm spaced from the end of the arm at the plate, said end portion of the arm being of smaller diameter than the head and extending from the head through said hole in the plate.

15. A chandelier as set forth in claim 12 wherein the means associated with the engageable with said one face of the plate comprises a washer having a hole receiving said end portion of the arm, the latter having at least one slot extending from its end presenting a shoulder at the inner end of the slot, the hole in the washer being shaped for engagement of the washer with the shoulder to keep the washer from sliding axially on the end portion of the arm away from the plate.

16. A chandelier as set forth in claim 11 wherein the plate is a sheet metal plate and the openings for receiving the detents are formed by pairs of tabs struck from the plate extending from the face of the plate on which the detent is located, each pair of tabs defining an opening therebetween for receiving an end portion of a respective detent.

17. A chandelier as set forth in claim 11 wherein the plate is a sheet metal plate, wherein each detent has a stud extending therefrom in the direction toward the plate, said openings being holes in the plate which receive said studs as the detents are rotated with the arms when the arms are swung from the collapsed to the operative position.

18. A chandelier as set forth in claim 17 wherein the studs are threaded for receiving nuts to secure them tightly in place in the holes.

19. A chandelier as set forth in claim 17 wherein the stud on each detent is a tab bent from the detent.

20. A chandelier as set forth in claim 10 wherein said each portion of each arm is a downwardly extending inner end portion of the arm, the arm having an outwardly extending intermediate portion and an upwardly extending outer portion carrying a lamp socket, said downwardly extending inner end portion of the arm extending down through said hole in the plate.

21. A chandelier as set forth in claim 10 having a tubular center column, the plate being attached to the lower end of the column, each arm having a downwardly extending inner end portion secured in the hole in the respective slide mount, an outwardly extending intermediate portion and an upwardly extending outer end portion carrying a lamp socket, the wiring extending through the column to below the plate and out to and up through the lower ends of the inner end portions of the arms, and a housing attachable to the plate for enclosing wiring below the plate.

22. A chandelier comprising an arm supporting plate, a plurality of arms mounted on the plate for pivotal movement about axes generally perpendicular to the plate from a collapsed position for shipment and storage to an operative position extending outwardly from the plate, each of said arms being a metal tubular arm accommodating electrical wiring therein and having an end portion rotatable in a hole in the plate for swinging the arm relative to the plate from a collapsed position of the arm to the operative position, the end portion of said arms having a latching member secured thereto extending radially therefrom on one face of the plate and rotatable with the arm for locating each arm in its respective operative position.

* * * * *